US011635206B2

(12) United States Patent
Munsterhuis et al.

(10) Patent No.: US 11,635,206 B2
(45) Date of Patent: Apr. 25, 2023

(54) METHOD AND CONTROLLER FOR OPERATING A GAS BURNER APPLIANCE

(71) Applicant: Pittway Sarl, Rolle (CH)

(72) Inventors: Sybrandus B. V. Munsterhuis, Dalen (NL); Gerrit Jan Baarda, Emmen (NL); Andreas Kammerahl, Lemfoerde (DE); Martin Petersmann, Osnabrueck (DE); Anton Quatmann, Vechta (DE); Ulrich Oldehus, Lohne (DE); Clemens Metker, Bad Iburg (DE)

(73) Assignee: Pittway Sarl, Rolle (CH)

( * ) Notice: Subject to any disclaimer, the term of this patent is extended or adjusted under 35 U.S.C. 154(b) by 87 days.

(21) Appl. No.: 17/242,773

(22) Filed: Apr. 28, 2021

(65) Prior Publication Data

US 2021/0364165 A1 Nov. 25, 2021

(30) Foreign Application Priority Data

May 22, 2020 (EP) ..... 20176036

(51) Int. Cl.
*F23N 1/02* (2006.01)

(52) U.S. Cl.
CPC ..... *F23N 1/025* (2013.01); *F23N 1/022* (2013.01); *F23N 2225/04* (2020.01); *F23N 2225/14* (2020.01)

(58) Field of Classification Search
CPC ..... F23N 1/022; F23N 1/025; F23N 2225/04; F23N 2225/14

(Continued)

(56) References Cited

U.S. PATENT DOCUMENTS 4,613,072 A * 9/1986 Kikuchi ..... B60H 1/2212 237/12.3 A
6,561,791 B1 5/2003 Vrolijk et al.
(Continued)

FOREIGN PATENT DOCUMENTS

CN 104654346 A 5/2015
DE 19824521 A1 12/1999
(Continued)

OTHER PUBLICATIONS

Extended Search Report from counterpart European Application No. 20176036.0, dated Sep. 21, 2020, 8 pp.

*Primary Examiner* — Vivek K Shirsat
(74) *Attorney, Agent, or Firm* — Greenberg Traurig, LLP; Ryan D. Sharp; David J. Dykeman

(57) ABSTRACT

In some examples, a method for operating a gas burner appliance includes determining, on basis of a nominal burner-load and on basis of a mixing ratio of gas and air of a gas/air mixture or a λ-value of the gas/air mixture, a nominal air mass flow in order to provide the nominal burner-load. The method further comprises determining the ambient air pressure and the ambient air temperature of the ambient air, determining, on basis of the ambient air pressure and on basis of the ambient air temperature, the atmospheric density of the ambient air, determining on basis of the nominal air mass flow, on basis of the determined atmospheric density of the ambient air, and on basis of a system resistance of the gas burner appliance, the fan speed of the fan in order to provide the nominal burner-load.

15 Claims, 3 Drawing Sheets

(58) Field of Classification Search
USPC ..... 431/12
See application file for complete search history.

(56) References Cited

U.S. PATENT DOCUMENTS

| | | | | |
|---|---|---|---|---|
| 8,303,297 | B2 | 11/2012 | Tompkins et al. | |
| 2016/0109157 | A1 | 4/2016 | Giaretta et al. | |
| 2022/0052359 | A1 * | 2/2022 | Fukushima ..... | H01M 8/04708 |

FOREIGN PATENT DOCUMENTS

| | | | |
|---|---|---|---|
| DE | 19929891 | A1 | 1/2001 |
| DE | 20117210 | U1 | 1/2002 |
| DE | 10144402 | A1 | 3/2003 |
| DE | 102017126137 | A1 | 5/2019 |
| DE | 102017126138 | A1 | 5/2019 |
| EP | 2667097 | A1 | 11/2013 |
| EP | 3255342 | A1 | 12/2017 |
| JP | H03233216 | A | 10/1991 |
| WO | 03098123 | A2 | 11/2003 |

* cited by examiner

METHOD AND CONTROLLER FOR OPERATING A GAS BURNER APPLIANCE

This application claims priority from European Patent Application No. 20176036.0, which was filed on May 22, 2020, and is incorporated herein by reference in its entirety.

TECHNICAL FIELD

The invention relates to a method for operating a gas burner appliance. Further on, the invention relates to a controller for operating a gas burner appliance.

BACKGROUND

EP 2 667 097 A1 discloses a method for operating a gas burner appliance. During burner-on-phases of the gas burner appliance, a gas/air mixture having a defined mixing ratio of gas and air is provided to a burner for combusting the gas/air mixture. The mixing ratio of gas and air of the gas/air mixture corresponds to the so-called λ-value of the gas/air mixture. The gas/air mixture is provided by a mixing device mixing an air flow provided by an air duct with a gas flow provided by a gas duct. The mixing device may be provided by a Venturi nozzle. The air flow flowing through the air duct is provided by fan in such a way that the fan speed of the fan depends on a nominal burner-load of the gas burner appliance, wherein a fan speed range of the fan defines a so-called modulation range of the gas burner appliance. According to EP 2 667 097 A1, the defined mixing ratio of gas and air and thereby the λ-value of the gas/air mixture is kept constant over the entire modulation range of the gas burner appliance by a pneumatic gas regulation valve. The pneumatic gas regulation valve is provided by a gas armature. In addition to the pneumatic gas regulation valve the gas armature comprises a safety gas valve and a throttle used for calibration. The pneumatic gas regulation valve uses a pressure difference between the gas pressure of the gas flow in the gas duct and a reference pressure, wherein either the air pressure of the air flow in the air duct or the ambient pressure is used as reference pressure, and wherein the pressure difference between the gas pressure of the gas flow in the gas duct and the reference pressure is determined and controlled pneumatically. EP 2 667 097 A1 discloses a method for operating a gas burner appliance in which the defined mixing ratio of the gas/air mixture is kept constant over the entire modulation range of the gas burner. This is done by the pneumatic gas regulation valve establishing a pneumatic control to keep the mixing ratio of gas and air within the gas/air mixture constant.

It is also possible to control the mixing ratio of gas and air within the gas/air mixture by an electric gas regulation valve.

DE 198 24 521 A1 discloses a method to control the mixing ratio of gas and air of the gas/air mixture and thereby the λ-value of the gas/air mixture on basis of a signal provided by an electrical or electronic pressure sensor or flow meter. An actual value corresponding to a pressure ratio between a gas pressure in a gas duct and an air pressure in an air duct or corresponding to a pressure ratio between the gas pressure in the gas duct and the air pressure at the reference point is provided by the electrical or electronic sensor, wherein this actual value is compared with a nominal value. A control variable for the electric gas regulation valve is generated on basis of the control deviation between the actual value and nominal value, wherein the electric gas regulation valve is adjusted on basis of this control variable to control the defined mixing ratio of gas and air in the gas/air mixture thereby keeping the λ-value of the gas/air mixture constant.

As mentioned above, the amount of the air flow and thereby the amount of the flow of the gas/air mixture having the defined mixing ratio of gas and air provided to the burner chamber depends on the desired burner load. The nominal burner-load corresponds to a desired heat demand. The nominal burner-load defines the fan speed at which the fan is operated. The fan speed range of the fan of the gas burner appliance defines the modulation range of the gas burner appliance. A maximum fan speed of the fan defines the maximum burner-load of the gas burner appliance. If a desired heat demand requires maximum burner load, then the fan is operated at maximum fan speed. If a desired heat demand requires burner-load being 50% of the maximum burner load, then the fan is operated at 50% of the maximum fan speed. If a desired heat demand requires burner-load being 20% of the maximum burner load, then the fan is operated at 20% of the maximum fan speed. As mentioned above, at any burner load of the gas burner appliance and at any fan sped of the fan the mixing ratio of gas and air of the is kept constant either by using an electric gas regulation valve or by using a pneumatic gas regulation valve.

Changes in the air density of the air of the gas/air mixture cause a change in the relationship of fan speed and burner load. If at a given fan speed the air density is low, then less oxygen is provided to the burner chamber causing a lower burner load than if at the same fan sped the air density is high. As the electric gas regulation valve or the pneumatic gas regulation valve keeps the mixing ratio of gas and air and thereby the λ-value of the gas/air mixture constant, no precise burner load can be assigned to a specific fan speed.

EP 3 255 342 B1 discloses a method and control unit for controlling and/or calibrating a heating system. The altitude at which the heating system is installed is determined and the fan speed of a fan is controlled on basis of the altitude. The altitude is determined by means of a pressure measurement or by reception of radio waves provided e.g. by a satellite navigation system carrying the altitude.

U.S. Pat. No. 8,303,297 B2 discloses a method and apparatus for controlling combustion in a burner system. The burner system comprises a barometric pressure sensor and a combustion air temperature sensor. The pressure and temperature sensor outputs are coupled to a controller. A fan speed of a fan is determined on basis of the pressure and temperature sensor outputs.

WO 03/098123 A2, CN 104 654 346 A, US 2016/0109157 A1, DE 199 29 891 A1, DE 101 44 402 A1, DE 201 17 210 U1 and JP H03 233 216 A disclose other prior art.

SUMMARY

There is a desire to increase control quality in operating a gas burner appliance.

Against this background, a novel method for operating a gas burner appliance is provided. The method according to the present invention comprises at least the following steps: Determine on basis of the nominal burner-load and on basis of the mixing ratio of gas and air of the gas/air mixture or the λ-value of the gas/air mixture a nominal air mass flow in order to provide the nominal burner-load. Determine the ambient air pressure and the ambient air temperature of the ambient air. Determine on basis of the ambient air pressure and on basis of the ambient air temperature the atmospheric density of the ambient air. Determine on basis of the nominal air mass flow, on basis of the determined atmospheric density of the ambient air and on basis of a system resistance of the gas burner appliance the fan speed of the fan in order to provide the nominal burner-load.

So, according to the present invention, the nominal air mass flow is determined on basis of the desired nominal burner-load and on basis of the mixing ratio of gas and air of the gas/air mixture or the λ-value of the gas/air mixture. Further, the atmospheric density of the ambient air is determined on basis of the ambient air pressure and on basis of the ambient air temperature of the ambient air. The fan speed is then determined on basis of nominal air mass flow, on basis of the determined atmospheric density of the ambient air and on basis of a system resistance of the gas burner appliance. The mixing ratio of gas and air of the gas/air mixture or the λ-value of the gas/air mixture and the system resistance of the gas burner appliance are assumed to be constant. This allows to increase the control quality in operating a gas burner appliance.

According to a preferred embodiment, the ambient air pressure of the ambient air is determined by measuring the same making use of a pressure sensor of the gas armature and the ambient air temperature of the ambient air is determined by measuring the same making use of a temperature sensor of the gas armature. At least one safety gas valve of the gas armature is operated by energizing at least one electric coil of the gas armature. The electric coil resistance of the respective electric coil is determined. A first temperature offset is determined as a function of the electric coil resistance of the respective electric coil and as a function of at least one time interval for which the respective electric coil becomes energized. The measured ambient air temperature is compensated by the first temperature offset thereby providing a compensated ambient air temperature. The atmospheric density of the ambient air is determined on basis of the ambient air pressure and on basis of the compensated ambient air temperature. This allows to further increase the control quality in operating a gas burner appliance.

According to a preferred embodiment, the defined mixing ratio of gas and air or the λue of the gas/air mixture is controlled over the modulation range of the gas burner appliance using an electric gas regulation valve. The electric gas regulation valve of the gas armature is operated by energizing an electric coil of the gas armature. The electric coil resistance of the electric coil is determined. A second temperature offset is determined as a function of the electric coil resistance of the electric coil and as a function of at least one time interval for which the electric coil becomes energized. The measured ambient air temperature is compensated by the second temperature offset thereby providing a compensated ambient air temperature. The atmospheric density is determined of the ambient air on basis of the ambient air pressure and on basis of the compensated ambient air temperature. This allows to further increase the control quality in operating a gas burner appliance.

The controller for operating a gas burner appliance according to the present invention is defined in claim 11.

Preferred developments of the invention are provided by the dependent claims and the description which follows.

BRIEF DESCRIPTION OF DRAWINGS

Exemplary embodiments are explained in more detail on the basis of the drawing, in which.

DETAILED DESCRIPTION

The present invention relates to a method and a controller for operating a gas burner appliance.

Figure 1:
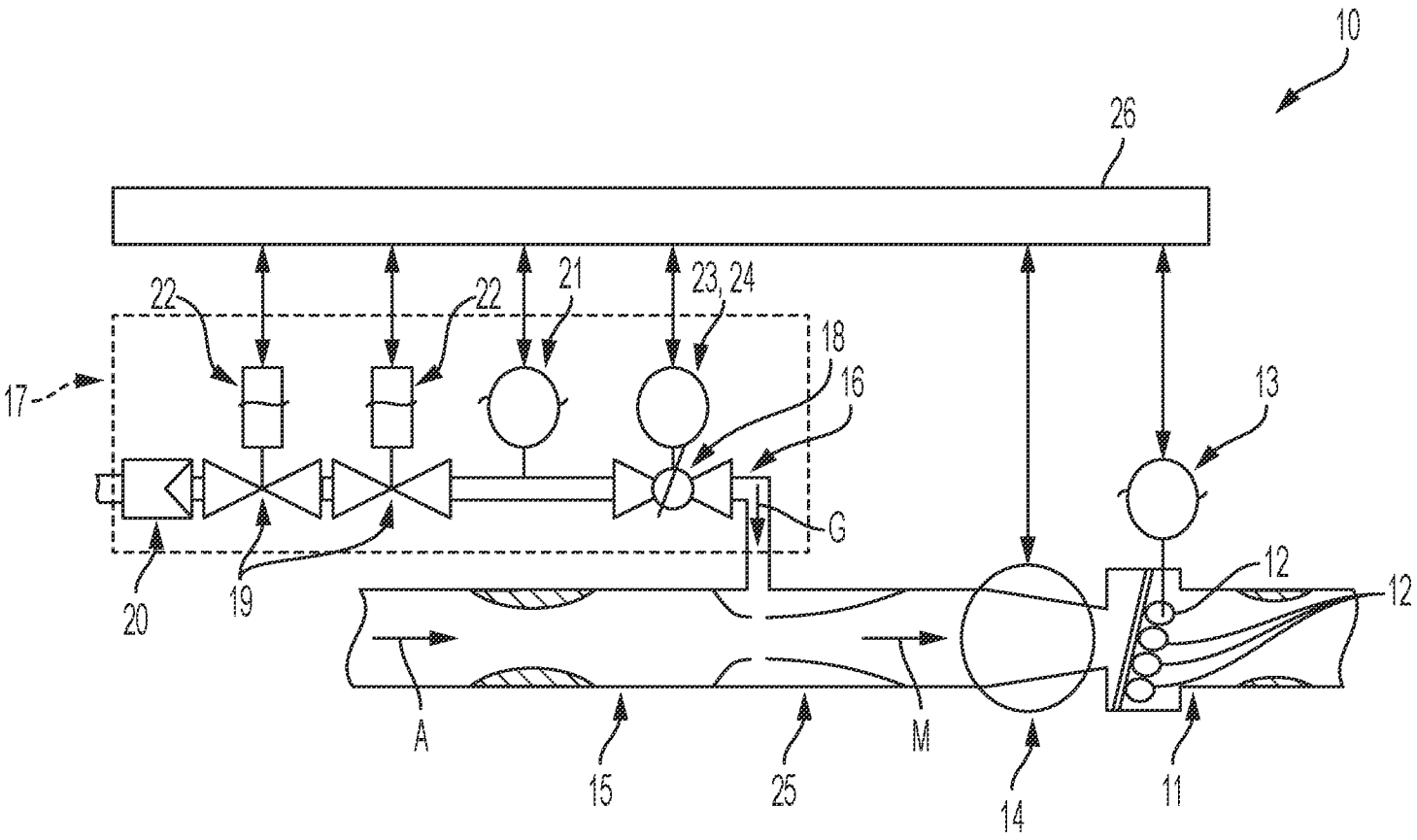
FIG. 1 shows a first gas burner appliance to be controlled by the method and controller of the present invention.

FIG. 1 shows a schematic view of a first exemplary gas burner appliance 10. The gas burner appliance 10 comprises a gas burner chamber 11 in which combustion of a gas/air mixture M having a defined mixing ratio of gas G and air A takes place during burner-on phases of the gas burner appliance 10.

The combustion of the gas/air mixture results into flames 12. The flames 12 are monitored by a combustion quality sensor, preferably by a flame ionization sensor 13 providing as output signal an electrical flame ionization current. The flame ionization sensor 13 provides its output signal to a controller 26.

The gas/air mixture M is provided to the burner chamber 11 of the gas burner appliance 10 by mixing a flow of the air A with a flow of the gas G. A fan 14 sucks in air A flowing through an air duct 15 and gas G flowing through a gas duct 16. A gas regulation valve 18 for adjusting the gas flow through the gas duct 16 and preferably two gas safety valves 19 are assigned to the gas duct 16.

The gas regulation valve 18 and the gas safety valves 19 are part of a gas armature 17 further comprising a sieve 20 and at least one sensor 21. In FIG. 1 the sensor 21 measures the ambient air pressure and the ambient air temperature. It is possible that the gas armature 17 may comprise separate sensors to measure the ambient air pressure and the ambient air temperature. The at least one sensor 21 provides its output signal to the controller 26.

The gas safety valves 19 are operated by electric coils 22 being part of the gas armature 17. In burner-on phases the electric coils 22 are energized by the controller 26 to open the gas safety valves 19. In burner-off phases the gas safety valves 19 are closed. In FIG. 1, each gas safety valve 19 is operated by one separate electric coil 22. It is possible to operate the gas safety valves 19 by a common electric coil 22.

The gas regulation valve 18 is operated by a motor 23 also having an electric coil 24. In FIG. 1, the gas regulation valve 18 is an electric gas regulation valve 18 operated by the controller 26.

The gas/air mixture M having the defined mixing ratio of gas G and air A is provided to the burner chamber 11 of the gas burner appliance 10. The gas/air mixture M is provided by mixing the air flow A provided by an air duct 15 with a gas flow G provided by a gas duct 16. The air flow and the gas flow become preferably mixed by a mixing device 25. The mixing device 25 may be a venturi nozzle.

The quantity of the air flow A and thereby the quantity of the gas/air mixture flow M is adjusted by the fan 14, namely by the speed of the fan 14. The fan speed can be adjusted on basis of a nominal burner-load. The fan 14 is operated by the controller 26. The fan speed range of the fan 14 defines a modulation range of the gas burner appliance 10. A modulation of "1" means that the fan 14 is operated at maximum fan speed (100% of maximum fan speed) and thereby at a full-load of the gas burner appliance 10. A modulation of "2" means that the fan 14 is operated at 50% of the maximum fan speed and a modulation of "5" means that the fan 14 is operated at 20% of the maximum fan speed. By changing the fan speed of the fan 14, the burner-load of the gas burner appliance 10 can be adjusted.

Over the entire modulation range of the gas burner appliance 10 the defined mixing ratio of gas G and air A within the gas/air mixture M and thereby the λ-value of the gas/air mixture M is kept constant. Said defined mixing ratio of gas G and air A or said λ-value of the gas/air mixture M is controlled over the modulation range of the gas burner appliance using the gas regulation valve 18 of a gas armature 17 in order to keep the defined mixing ratio of gas and air and thereby the λ-value constant over the modulation range of the gas burner appliance 10. In FIG. 1, the control variable for the electric gas regulation valve 18 in order to keep the λ-value constant is generated by the controller 26 on basis of the flame ionization current provided by the flame ionization sensor 13.

Figure 2:
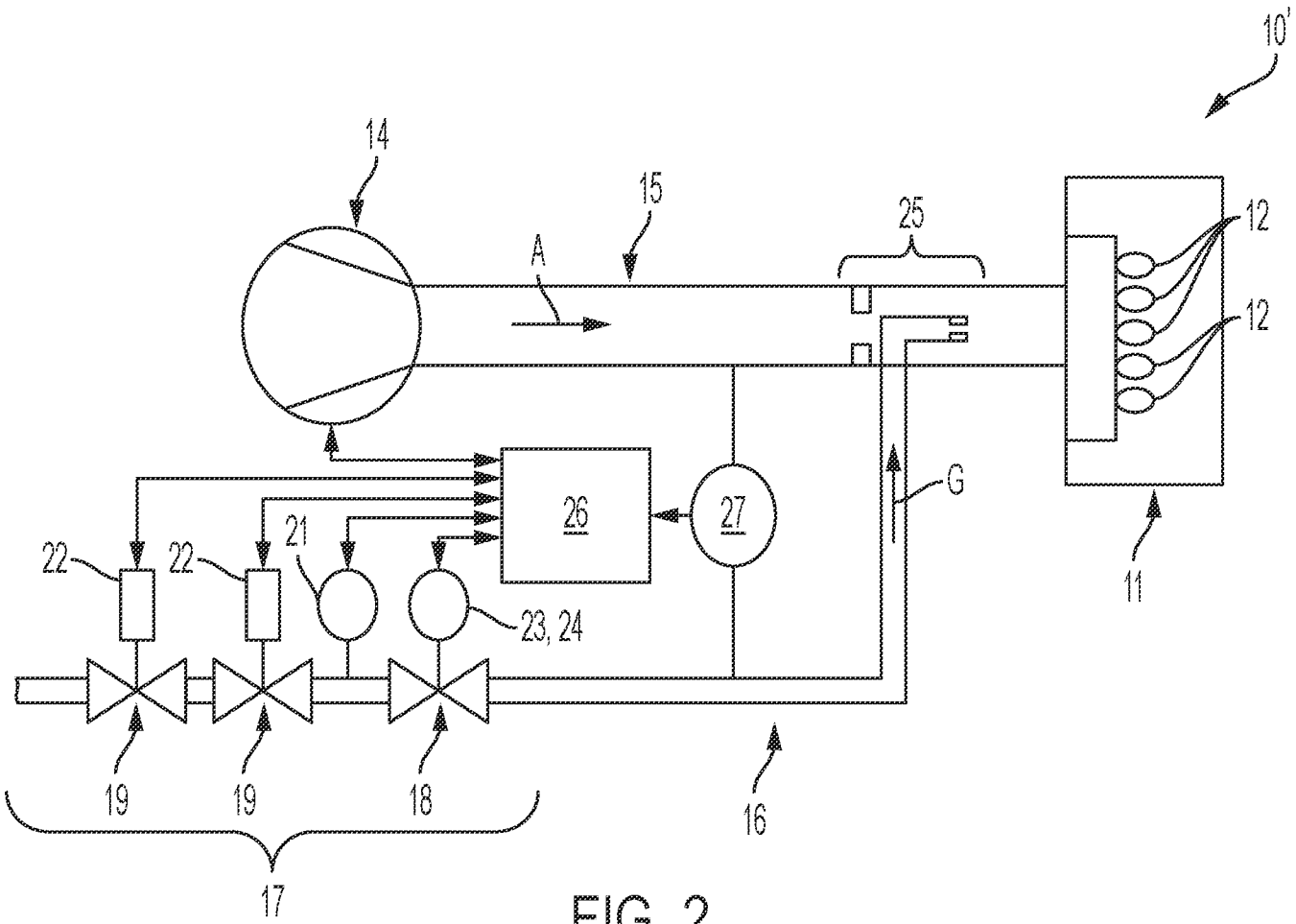
FIG. 2 shows a second gas burner appliance to be controlled by the method and controller of the present invention.
Figure 3:
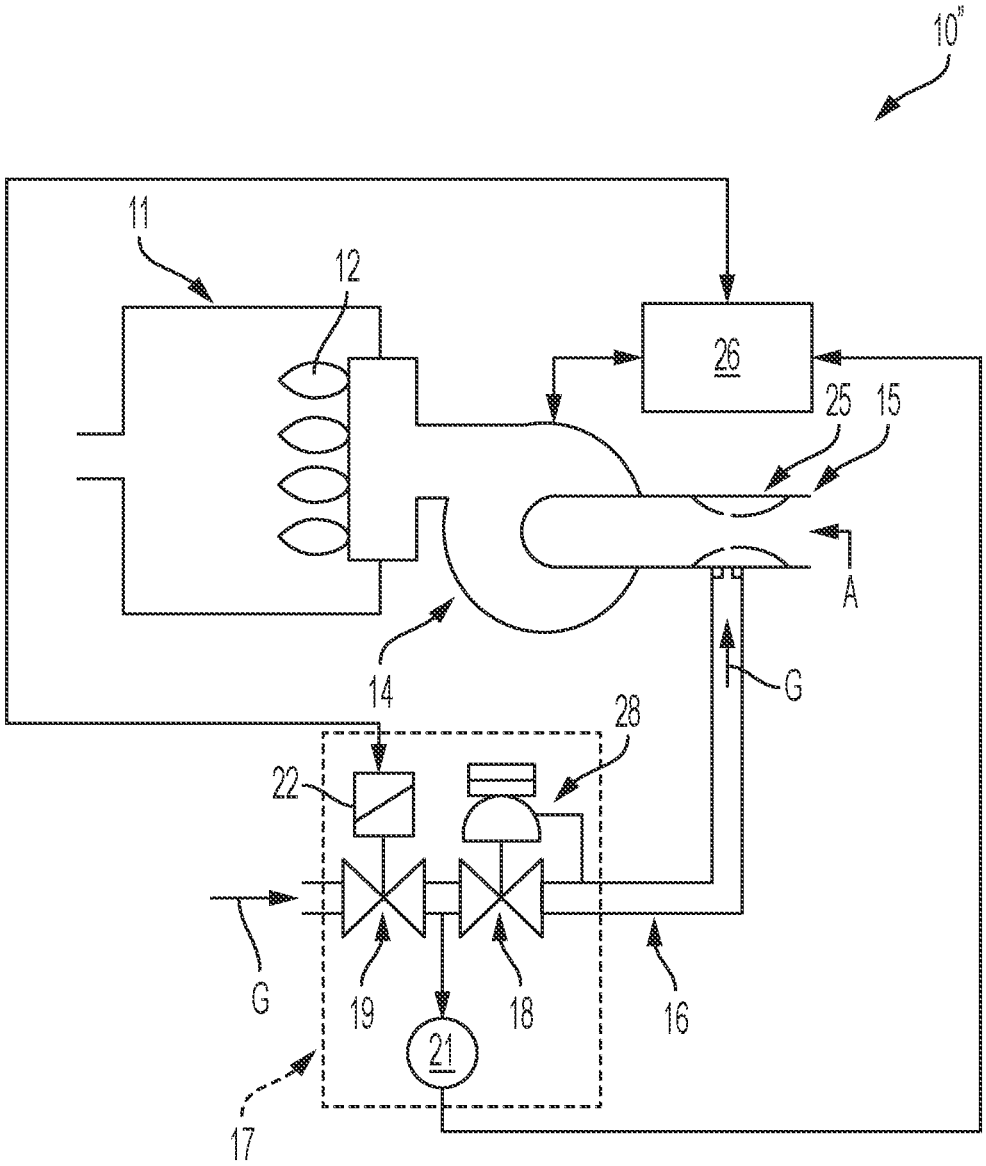
FIG. 3 shows a third gas burner appliance to be controlled by the method and controller of the present invention.

FIGS. 2 and 3 shows schematic views of a other exemplary gas burner appliances 10' and 10". In FIGS. 1, 2 and 3 identical reference numbers are used for identical parts. In order to avoid unnecessary repetitions, below only the differences of the gas burner appliances 10, 10' and 10, 10" will be described.

In FIG. 2, the constant mixing ratio of gas G and air A within the gas/air mixture M is controlled by the electric gas regulation valve 18 on basis of a signal provided by an electric or electronic pressure sensor or flow meter 27 and not on basis of the flame ionization current provided by the flame ionization sensor 13. In this case the electric or electronic sensor 27 may provide to the controller 26 an actual value corresponding to a pressure ratio between a gas pressure in a gas duct 16 and an air pressure in an air duct 15 or corresponding to a pressure ratio between the gas pressure in the gas duct 16 and the air pressure at the reference point, wherein the controller 26 may compare said actual value with a nominal value. In this case, the controller 26 may generate the control variable for the electric gas regulation valve 18 on basis of the control deviation between the actual value and the nominal value, wherein the gas regulation valve 18 may be operated on basis of this control variable to keep over the entire modulation range of the gas burner appliance 10 the defined mixing ratio of gas and air and thereby the λ-value constant.

In FIG. 3, the gas armature 17 comprises a pneumatic gas regulation valve 18. A pneumatic controller 28 of the pneumatic gas regulation valve 18 controls the opening/closing position of the gas regulation valve 18. The position of the pneumatic gas regulation valve 18 is adjusted by the pneumatic controller 28 on basis of a pressure difference between the gas pressure of the gas flow in the gas duct 16 and a reference pressure. The pneumatic gas regulation valve 18 is controlled by the pneumatic controller 28 in such a way that at the outlet pressure of the gas regulation valve 18 is equal to the reference pressure. In FIG. 1, the ambient pressure serves as reference pressure. However, it is also possible to use the air pressure of the air flow in the air duct 15 as reference pressure.

In FIG. 3, the pressure difference between the gas pressure and the reference pressure is determined pneumatically a by pneumatic sensor of the pneumatic controller 28. The mixing ratio of the defined gas/air mixture is controlled by the pneumatic controller 28 in such a way that over the entire modulation range of the gas burner appliance 10 the defined mixing ratio of the gas/air mixture M and thereby the λ-value constant is kept constant.

According to the present invention the method for operating a gas burner appliance, preferably the gas burner appliances 10, 10' and 10" of FIGS. 1, 2 and 3, comprises at least the following steps:

Determine on basis of the nominal burner-load and on basis of the mixing ratio of gas and air of the gas/air mixture M or the λ-value of the gas/air mixture M a nominal air mass flow in order to provide the nominal burner-load. The mixing ratio of gas and air of the gas/air mixture M or the λ-value of the gas/air mixture M is known and assumed to be constant.

Determine the ambient air pressure and the ambient air temperature of the ambient air. The ambient air pressure and the ambient air temperature are preferably measured by the sensor 21 of the gas armature 17. The gas armature may have separate sensors to measure ambient air pressure and the ambient air temperature.

Determine on basis of the ambient air pressure and on basis of the ambient air temperature the atmospheric density of the ambient air. The atmospheric density of the ambient air may be calculated from the measured ambient air pressure and the measured ambient air temperature. Alternatively, the atmospheric density of the ambient air may be determined from the measured ambient air pressure and the measured ambient air temperature using a characteristic curve or characteristic map.

Determine on basis of the nominal air mass flow, on basis of the determined atmospheric density of the ambient air and on basis of a system resistance of the gas burner appliance 10, 10' and 10" the fan speed of the fan 14 in order to provide the nominal burner-load. The system resistance of the gas burner appliance 10, 10' and 10" is assumed to be constant.

The method for operating a gas burner appliance according to the present invention allows to increase the control quality in operating a gas burner appliance.

As mentioned above, the at least one safety gas valve 19 of the gas armature 17 of the respective gas burner appliance 10, 10' and 10" is operated by energizing the at least one respective electric coil 22 of the gas armature 17. To further increase the control quality in operating a gas burner appliance, the method for operating the gas burner appliance 10, 10' and 10" may comprise the following additional steps:

Determine the electric coil resistance of the respective electric coil 22. Preferably, the electric coil resistance of the respective electric coil 22 is calculated on basis of the electrical current and on basis of the electrical voltage both measured at or across the respective electric coil 22.

Determine a first temperature offset as a function of the electric coil resistance of the respective electric coil 22 and as a function of at least one time interval for which the respective electric coil 22 becomes energized.

Compensate the measured ambient air temperature by the first temperature offset thereby providing a compensated ambient air temperature.

Determine the atmospheric density of the ambient air on basis of the ambient air pressure and on basis of the compensated ambient air temperature. The fan speed of the fan 14 which is needed in order to provide the nominal burner-load is then determined on basis of the nominal air mass flow, on basis of the atmospheric density determined on basis of the compensated ambient air temperature.

In the gas burner appliances 10, 10' of FIGS. 1 and 2 the mixing ratio of gas and air or the λ-value of the gas/air mixture is controlled over the modulation range of the gas burner appliance 10 using the respective electric gas regulation valve 18. The respective electric gas regulation valve 18 is operated by energizing the respective electric coil 24 of the respective motor 23 of the respective gas armature 17. To further increase the control quality in operating a gas burner appliance, the method for operating the gas burner appliance 10, 10' and 10" may comprise the following additional steps:

Determining the electric coil resistance of the electric coil 24 of the motor 23 of the respective gas armature 17. Preferably, the electric coil resistance of the respective coil 24 is calculated on basis of the electrical current and on basis of the electrical voltage both measured at or across the electric coil 24.

Determine a second temperature offset as a function of the electric coil resistance of the electric coil 24 of the motor 23 and as a function of at least one time interval for which the electric coil 24 becomes energized.

Compensate the measured ambient air temperature by the first temperature offset and by the second temperature offset thereby providing a compensated ambient air temperature.

Determine the atmospheric density of the ambient air on basis of the ambient air pressure and on basis of the compensated ambient air temperature. The fan speed of the fan 14 which is needed in order to provide the nominal burner-load is determined on basis of the nominal air mass flow, on basis of the atmospheric density determined on basis of the compensated ambient air temperature.

In the gas burner appliances 10, 10', 10" of FIGS. 1, 2, 3 the sensor 21 measures the ambient air pressure downstream of at least one safety gas valve 19 and upstream of the gas regulation valve 18 all being part of the gas armature 17.

The ambient air pressure measured by the sensor 21 is only used in connection with the above described method when the at least one safety gas valve 19 is closed, and when the gas regulation valve 18 is opened, and when the fan 14 is stopped.

The invention further provides a controller 26 for operating the gas burner appliance 10, 10', 10". The controller 26 is configured to operate the gas burner appliance 10, 10', 10" according to the above described method.

The controller 26 is configured to determine on basis of a heat demand a nominal burner-load to provide the heat demand, wherein the nominal burner-load is a load within a modulation range of the gas burner appliance 10, 10', 10".

The controller 26 is configured to determine on basis of the nominal burner-load a fan speed of the fan 14 of the gas burner appliance 10, 10', 10" which is needed to provide the burner load, wherein a fan speed range of the fan 14 defines the modulation range of the gas burner appliance 10, 10', 10".

The controller 26 is configured to determine on basis of the nominal burner-load and on basis of a mixing ratio of gas and air of the gas/air mixture or a λ-value of the gas/air mixture a nominal air mass flow in order to provide the nominal burner-load.

The controller 26 is further configured to determine on basis of an ambient air pressure and on basis of an ambient air temperature the atmospheric density of the ambient air.

The controller 26 is further configured to determine on basis of the nominal air mass flow, on basis of the determined atmospheric density of the ambient air and on basis of a system resistance of the gas burner appliance the fan speed of the fan in order to provide the nominal burner-load.

Preferably, the controller 26 is configured to receive the ambient air pressure from the pressure sensor 21 of the gas armature 17 and to receive the ambient air temperature from the temperature sensor 21 of the gas armature 17. The controller 26 is configured to determine the electric coil resistance of the at least one electric coil 22, 24 the gas armature 17 as described above. The controller 26 is configured to determine the at least one temperature offset as a function of the electric coil resistance of the respective electric coil 22, 24 and as a function of at least one time interval for which the respective electric coil 22, 24 becomes energized. The controller 26 is configured to compensate the measured ambient air temperature by the at least one temperature offset thereby providing a compensated ambient air temperature. The controller 26 is configured to determine the atmospheric density of the ambient air on basis of the ambient air pressure and on basis of the compensated ambient air temperature.

LIST OF REFERENCE SIGNS

10 gas burner appliance
10' gas burner appliance
10" gas burner appliance
11 burner chamber
12 flame
13 flame ionization sensor
14 fan
15 air duct
16 gas duct
17 gas armature
18 gas regulation valve
19 safety gas valve
20 sieve
21 air pressure and air temperature sensor
22 coil
23 motor
24 coil
25 mixer
26 controller
27 electric or electronic sensor
28 pneumatic controller

The invention claimed is:

1. A method for operating a gas burner appliance, the method comprising:

providing a flow of a gas/air mixture having a defined mixing ratio of gas and air or a defined λ-value to a burner chamber of the gas burner appliance for combusting the gas/air mixture within the burner chamber, wherein the gas/air mixture is provided by a mixing device of the gas burner appliance mixing an air flow with a gas flow, wherein the air flow or the flow of the gas/air mixture is provided by a fan of the gas burner appliance in such a way that a fan speed of the fan depends on a nominal burner-load of the gas burner appliance, wherein the fan speed range of the fan defines a modulation range of the gas burner appliance, wherein the mixing ratio of gas and air or the λ-value of the gas/air mixture is controlled over the modulation range using a gas regulation valve of a gas armature in order to keep the defined mixing ratio of gas and air or the λ-value constant over the modulation range of the gas burner appliance;

determining on basis of the nominal burner-load and on basis of the mixing ratio of gas and air of the gas/air mixture or the λ-value of the gas/air mixture a nominal air mass flow in order to provide the nominal burner-load, determining the ambient air pressure and the ambient air temperature of the ambient air, determining on basis of the ambient air pressure and on basis of the ambient air temperature the atmospheric density of the ambient air, determining on basis of the nominal air mass flow, on basis of the determined atmospheric density of the ambient air and on basis of a system resistance of the gas burner appliance the fan speed of the fan in order to provide the nominal burner-load.

2. The method of claim 1, wherein the ambient air pressure of the ambient air is determined by measuring the same making use of a pressure sensor of the gas armature.

3. The method of claim 2, wherein the pressure sensor measures the ambient air pressure downstream of at least one safety gas valve and upstream of the gas regulation valve all being part of the gas armature, namely when the at least one safety gas valve is closed and when the gas regulation valve is opened and when the fan is stopped.

4. The method of claim 2, wherein the ambient air temperature of the ambient air is determined by measuring the same making use of a temperature sensor of the gas armature.

5. The method of claim 4, further comprising:

operating at least one safety gas valve of the gas armature by energizing at least one electric coil of the gas armature;

determining the electric coil resistance of the respective electric coil;

determining a first temperature offset as a function of the electric coil resistance of the respective electric coil and as a function of at least one time interval for which the respective electric coil becomes energized;

compensating the measured ambient air temperature by the first temperature offset thereby providing a compensated ambient air temperature; and determining the atmospheric density of the ambient air on basis of the ambient air pressure and on basis of the compensated ambient air temperature.

6. The method of claim 5, further comprising:

measuring an electrical current of the respective electric coil;

measuring an electrical voltage across the respective electric coil; and calculating the electric coil resistance of the respective electric coil on basis of the measured electrical current and on basis of the measured electrical voltage.

7. The method of claim 1, wherein the mixing ratio of gas and air or the λ-value is controlled over the modulation range of the gas burner appliance using a pneumatic gas regulation valve of the gas burner appliance.

8. The method of claim 1, wherein the mixing ratio of gas and air or the λ-value is controlled over the modulation range of the gas burner appliance using an electric gas regulation valve of the gas burner appliance.

9. The method of claim 8, wherein:

the electric gas regulation valve controls the mixing ratio of gas and air or the λ-value of the gas/air mixture in such a way that a flame ionization current is measured by a flame ionization sensor of the gas burner appliance monitoring flames resulting from the combustion of the gas/air mixture within the combustion chamber, and a control variable for the electric gas regulation valve is generated on basis of the flame ionization current, or a pressure difference between the gas pressure and the air pressure is measured by an electric or electronic sensor of the gas burner appliance, and a control variable for the electric gas regulation valve is generated on basis of the output signal provided by the electric or electronic sensor.

10. The method of claim 8, further comprising:

operating the electric gas regulation valve of the gas armature by energizing an electric coil of the gas armature;

determining the electric coil resistance of the electric coil;

determining a second temperature offset as a function of the electric coil resistance of the electric coil and as a function of at least one time interval for which the electric coil becomes energized;

compensating the measured ambient air temperature by the second temperature offset thereby providing a compensated ambient air temperature; and determining the atmospheric density of the ambient air on basis of the ambient air pressure and on basis of the compensated ambient air temperature.

11. A controller of a gas burner appliance for operating the gas burner appliance, the controller being configured to:

determine on basis of a heat demand a nominal burner-load to provide the heat demand, wherein the nominal burner-load is a load within a modulation range of the gas burner appliance, determine on basis of the nominal burner-load a fan speed of a fan of the gas burner appliance which is needed to provide the burner load, wherein a fan speed range of the fan defines the modulation range of the gas burner appliance, determine on basis of the nominal burner-load and on basis of a mixing ratio of gas and air of the gas/air mixture or a λ-value of the gas/air mixture a nominal air mass flow in order to provide the nominal burner-load, determine on basis of an ambient air pressure and on basis of an ambient air temperature the atmospheric density of the ambient air, determine on basis of the nominal air mass flow, on basis of the determined atmospheric density of the ambient air and on basis of a system resistance of the gas burner appliance the fan speed of the fan in order to provide the nominal burner-load.

12. The controller of claim 11, wherein:

the controller is configured to receive the ambient air pressure from a pressure sensor of a gas armature, the controller is configured to receive the ambient air temperature from a temperature sensor of the gas armature, the controller is configured to determine an electric coil resistance of at least one electric coil the gas armature, the controller is configured to determine at least one temperature offset as a function of the electric coil resistance of the respective electric coil and as a function of at least one time interval for which the respective electric coil becomes energized, the controller is configured to compensate the measured ambient air temperature by the at least one temperature offset thereby providing a compensated ambient air temperature, and the controller is configured to determine the atmospheric density of the ambient air on basis of the ambient air pressure and on basis of the compensated ambient air temperature.

13. The controller of claim 12, wherein the controller is configured to:

determine an electrical current of the respective electric coil, determine an electrical voltage across the respective electric coil; and calculate the electric coil resistance of the respective electric coil on basis of the electrical current and on basis of the electrical voltage.

14. The controller of claim 11, wherein the controller is configured to control the mixing ratio of gas and air or the λ-value over the modulation range of the gas burner appliance using a pneumatic gas regulation valve of the gas burner appliance.

15. The controller of claim 11, wherein the controller is configured to control the mixing ratio of gas and air or the λ-value over the modulation range of the gas burner appliance using an electric gas regulation valve of the gas burner appliance.

* * * * *